US005373649A

United States Patent [19]

Choi

[11] Patent Number: 5,373,649

[45] Date of Patent: Dec. 20, 1994

[54] SPORTS SHOES HAVING EXCHANGEABLE HEELS

[76] Inventor: Jung S. Choi, 809-812, Joogong Apt. 611, Ilwon-dong, Kangnam-ku, Seoul, Rep. of Korea

[21] Appl. No.: 230,481

[22] Filed: Apr. 20, 1994

[30] Foreign Application Priority Data

Apr. 30, 1993 [KR] Rep. of Korea ..... 1993-7116

[51] Int. Cl.[5] ..... A43B 21/36

[52] U.S. Cl. ..... 36/42; 36/36 R

[58] Field of Search ..... 36/42, 41, 36 R, 36 A, 36/36 B, 36 C

[56] References Cited

U.S. PATENT DOCUMENTS

| | | | |
|---|---|---|---|
| 1,052,441 | 2/1913 | Hazeltine | 36/42 |
| 1,685,871 | 10/1928 | Asher | 36/42 |
| 1,743,543 | 1/1930 | Gutierrez | 36/42 |
| 2,582,551 | 1/1952 | Malherbe | 36/42 |
| 2,806,302 | 9/1957 | Sharpe | 36/42 |
| 4,214,384 | 7/1980 | Gonzales | 36/42 |
| 4,610,100 | 9/1986 | Rhodes | 36/42 |
| 4,670,996 | 6/1987 | Dill | 36/42 |
| 4,805,320 | 2/1989 | Goldenberg et al. | 36/42 |
| 5,025,574 | 6/1991 | Lasher, III | 36/42 |
| 5,058,290 | 10/1991 | Koehl et al. | 36/42 |

FOREIGN PATENT DOCUMENTS

| | | | |
|---|---|---|---|
| 13913 | of 1897 | United Kingdom | 36/42 |
| 19905 | of 1899 | United Kingdom | 36/42 |
| 371 | 1/1908 | United Kingdom | 36/36 R |

*Primary Examiner*—Steven N. Meyers

*Attorney, Agent, or Firm*—Dressler, Goldsmith, Shore & Milnamow, Ltd.

[57] ABSTRACT

Sports shoes having exchangeable heels. Each the exchangeable heel is detachably attached to a heel section of a sole such that it is exchanged with the other heel. The heel is axially recessed on its top center to have a trapezoidal recessed rail and has a pair of inserts. The inserts protrude forward from a front end of the heel and is spaced apart from and parallel to each other and have downward wedges at their ends. The sole is recessed at its rear section to form the heel section which has an trapezoidal protruding rail for substantially meeting with the trapezoidal recessed rail of the heel. A pair of snap units is movably provided in the sole for snapping up the downward wedges of the inserts of the heel respectively. Each the snap unit comprises a movable snapping member partially having an upward wedge for engaged with the downward wedge of the insert of the heel and an elastic member elastically movably mounting the snapping member in the sole such that the snapping member is elastically inwardly pushed and allows the downward wedge of the insert of the heel to be disengaged from the upward wedge of the snapping member.

1 Claim, 3 Drawing Sheets

SPORTS SHOES HAVING EXCHANGEABLE HEELS

BACKGROUND OF THE INVENTION

1. Field of the Invention

The present invention relates in general to sports shoes and, more particularly, to structural improvement of heels of the sports shoes for achieving uniform abrasion of the heels.

2. Description of the Prior Art

As the sports shoes are put on, their heels are worn down in such a manner that the outside of each heel is more worn down than the inside as shown in FIG. 6. Such an eccentric abrasion of the heels is caused by the fact that the load applied to the outer bottoms of the heels is not uniform. This eccentric abrasion is observable among oriental people who generally walk with their toes pointed inwardly. The eccentric abrasion of the heels becomes worse according to the passage of time since the inside parts or the unworn parts of the heels function as fulcrums of the levers while the outside parts or the worn parts of the heels function as points of action and, as a result, the load applied to the heels leans to the outside parts of the heels. Such an eccentric abrasion of the heels also causes the rear parts of the shoe bodies to be squeezed out of their normal states.

The above eccentric abrasion of the heels and the squeezing of the rear parts of the shoe bodies not only cause discomfort to a wearer but also cause the wearer to be injured in the ankle, which may be thus fractured or twisted. Particularly, such an injury in the ankle is common among vigorous, young boys and girls.

To prevent the aforementioned problems caused by the eccentric abrasion of the heels and the squeezing of the rear parts of the shoe bodies, the shoes whose heels are worn down should be discarded even when the other parts of the shoes are still good to wear. However, it is uneconomical to do so. Furthermore, discarding of such shoes causes a national economic problem in that it runs counter to the effective use of resources.

To combat this problem, this applicant proposed, in Korean Utility Model Appln. No. 92-874, a separable heel which can be detachably attached to the rear part of a shoe. However, it has been noted that the above separable heel has some problems which should be overcome.

SUMMARY OF THE INVENTION

It is, therefore, an object of the present invention to provide sports shoes having interchangeable heels in which each heel can be separated and exchanged with the other heel to lengthen the useful life of the shoes.

It is another object of the present invention to provide sports shoes having exchangeable heels in which each heel is separable and exchangeable with the other heel, thus to prevent the eccentric abrasion of the heels.

It is a further object of the present invention to provide sports shoes having exchangeable heels which prevent the wearer from being injured in his ankle by the eccentric abrasion of the heels.

It is yet another object of the present invention to provide sports shoes having exchangeable heels in which each heel can be easily separated from one shoe and easily attached to another shoe.

In order to accomplish the above objects, each sports shoe in accordance with an embodiment of this invention comprises a heel detachably attached to a heel section of a sole such that the heel is exchangeable with another heel. The heel is axially recessed on its top center to have a trapezoidal recessed rail and has a pair of inserts protruding forwardly from a front end of the heel. The inserts are spaced apart from and parallel to each other and have downward wedges at their ends. The sole is recessed at its rear section to form the heel section. The heel section has a trapezoidal protruding rail on its outer bottom for mating with the trapezoidal recessed rail of the heel.

Each sports shoe in accordance with the embodiment noted in the preceding paragraph further comprises a pair of snap units movably provided in the sole for snapping up the downward wedges of the inserts of the heel respectively. Each snap unit comprises a movable snapping member partially having an upward wedge for engagement with the downward wedge of a corresponding insert of the heel and an elastic member elastically movably mounting the snapping member in the sole such that, when the snapping member is elastically inwardly pushed, the snapping member allows the downward wedge of the insert of the heel to be disengaged from the upward wedge of the snapping member.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENT

Figure 1:
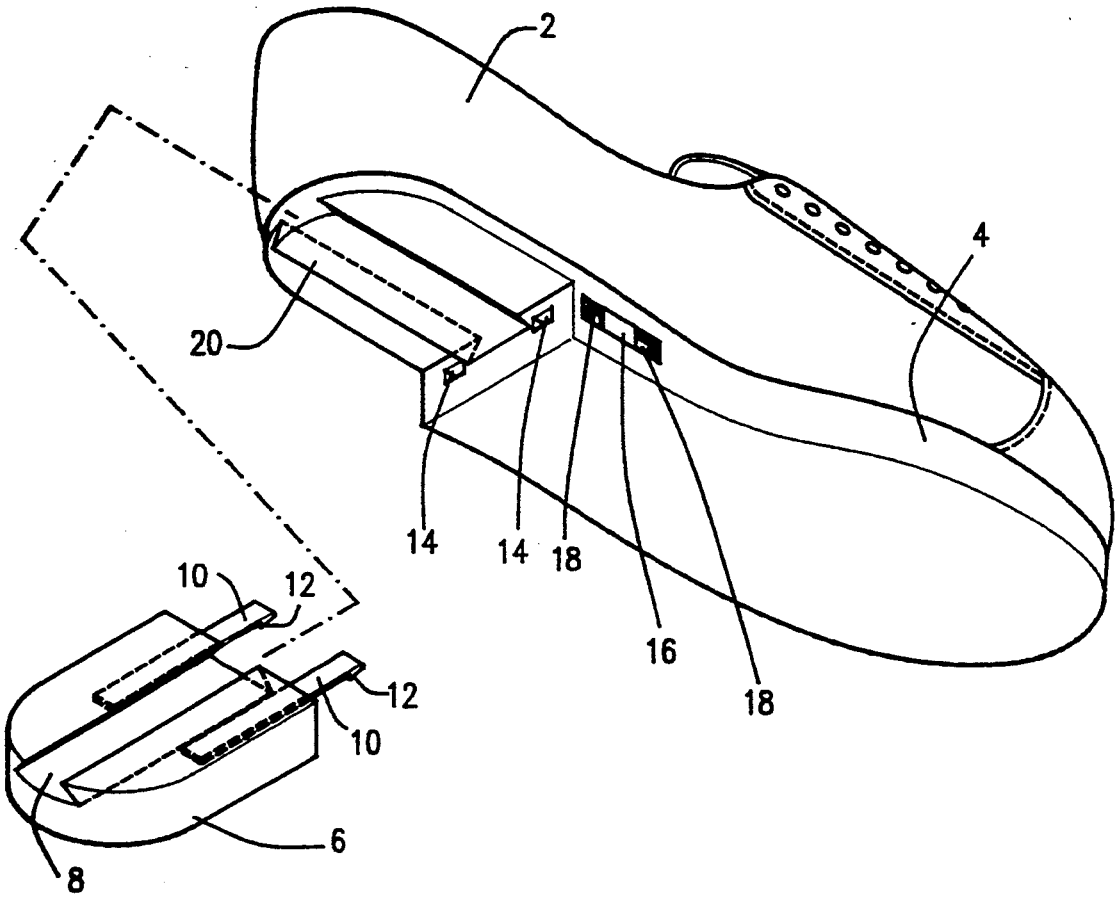
FIG. 1 is an exploded bottom perspective view of one of sports shoes having exchangeable heels in accordance with a preferred embodiment of the present invention.

With reference to FIG. 1, there is shown in an exploded bottom perspective view one of sports shoes having exchangeable heels in accordance with a preferred embodiment of the present invention. The shoe body 2 includes a trapezoidal protruding rail 20 at the outer bottom of the rear section or the heel section of a sole 4. The exchangeable heel 6, which will be detachably attached to the heel section of the sole 4, is provided with a trapezoidal recessed rail 8 which will substantially mate with the trapezoidal protruding rail 20. The heel 6 is also provided with a pair of inserts 10 at its front section such that the inserts 10 protrude forward from the front end of the heel 6 and are spaced apart from and parallel to each other. Those inserts 10 of the heel 6 are constructed of a plastic material, a metal material or a combination thereof, and are provided at their ends with downward wedges 12 respectively.

Figure 5:
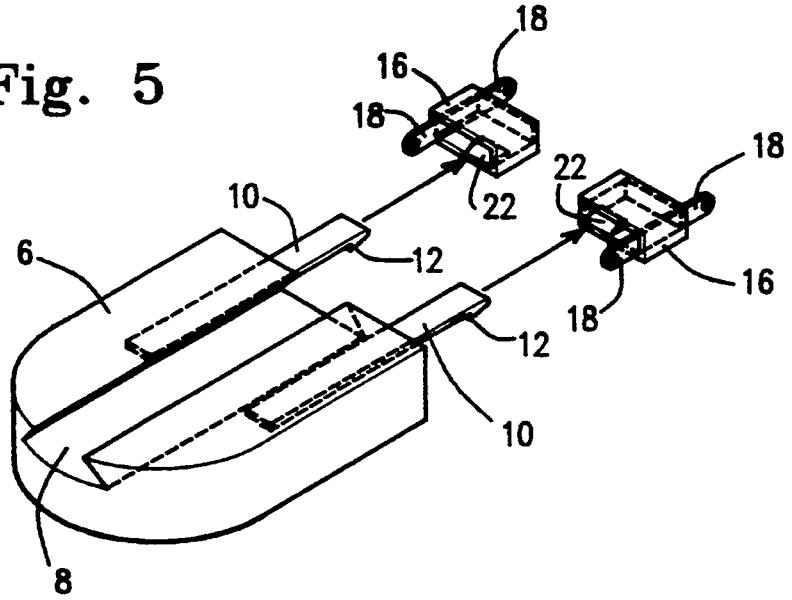
FIG. 5 is an exploded perspective view of a pair of snap units and the exchangeable heel of FIG. 1.
Figure 6A:
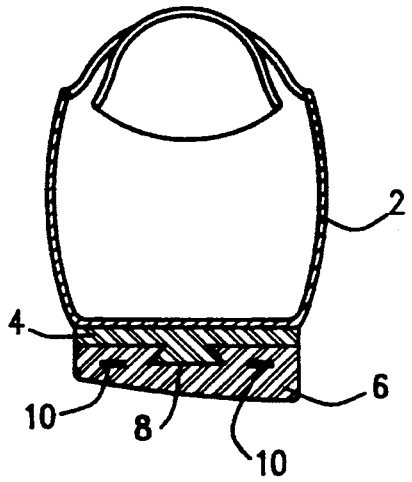
FIGS. 6A to 6D are sectional views of the sports shoes having the exchangeable heels, showing the eccentric abrasion of the heels and exchanging of the heels for compensating the eccentric abrasion.
Figure 6B:
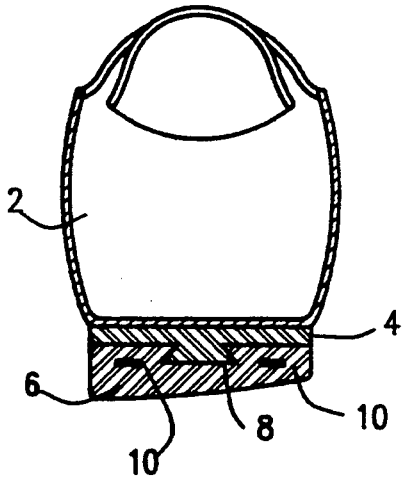
Figure 6C:
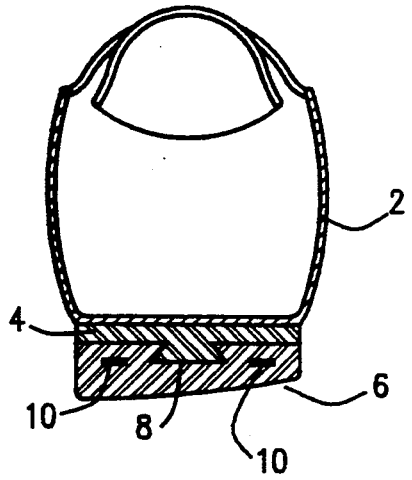
Figure 6D:
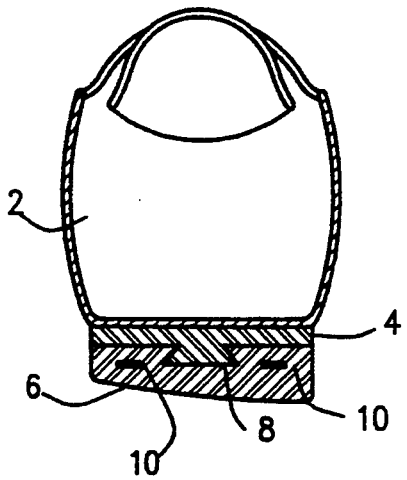

In order to mate with the inserts 10 of the heel 6, the sole 4 of the shoe is provided with a pair of insert holes 14. In coupling the heel 6 to the heel section of the sole 4, the inserts 10 of the heel 6 are inserted into their respective insert holes 14 and snap into their places of snapping means provided in the insert holes 14. The snapping means comprises a pair of snap units 16, each of which comprises an elastic member 18 and a snapping member partially having an upward wedge 22 as shown in FIG. 5. The elastic member 18 movably mounts the snapping member in the sole 4 such that, when the snapping member is elastically inwardly pushed, the snapping member allows the downward wedge 12 of the insert 10 of the heel 6 to be disengaged from the upward wedge 22 of the snapping member.

Figure 2:
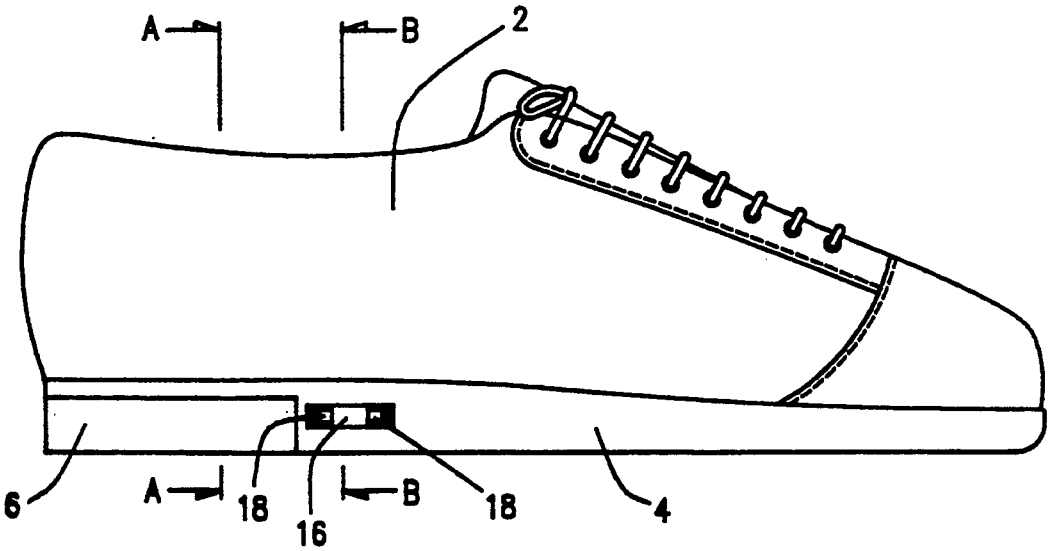
FIG. 2 is a side view of the sports shoe of FIG. 1 in an assembled state.
Figure 3:
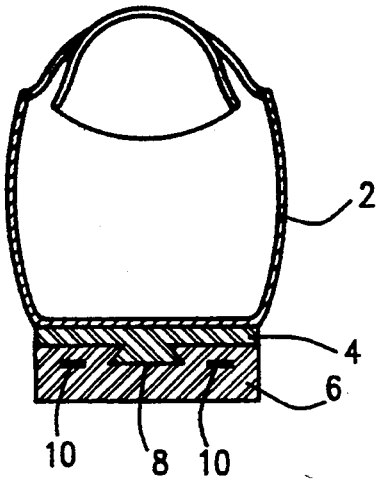
FIG. 3 is a sectional view of the sports shoe taken along the section line A—A of FIG. 2.
Figure 4:
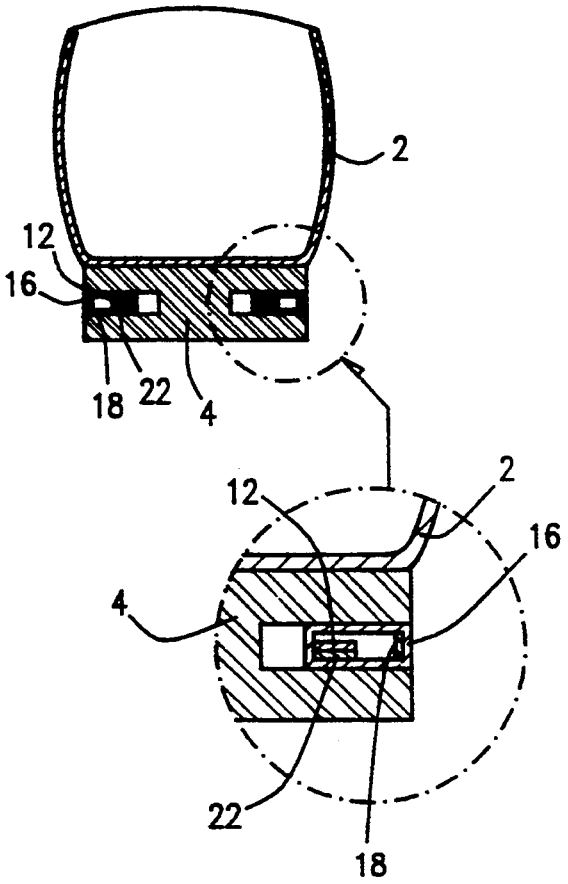
FIG. 4 is a sectional view of the sports shoe taken along the section line B—B of FIG. 2.

FIG. 2 is a side view of the sports shoe of FIG. 1 in an assembled state, and FIGS. 3 and 4 are sectional views of the sports shoe taken along the section lines A—A and B—B of FIG. 2 respectively.

The elastic member 18 is a band formed of, for example, rubber and mounted in the sole 4 such that it allows the snapping member having the wedge 22 to be laterally inwardly pushed. Here, the snap unit 16 is not fixed to the sole 4 at its outer surface but is movably mounted in the sole 4 such that it slides in the sole 4.

In coupling the heel 6 to the heel section of the sole 4, the heel 6 is pushed forward while substantially mating the trapezoidal recessed rail 8 of the heel 6 with the trapezoidal protruding rail 20 of the heel section of the sole 4. As a result of forward pushing of the heel 6 with respect to the heel section, the inserts 10 of the heel 6 are inserted into their respective insert holes 14 of the sole 4 so that the downward wedges 12 of the inserts 10 snap into their places of the upward wedges 22 of the snap units 16.

In order to separate the heel 6 from the heel section of the sole 4, the snap units 16 of the sole 4 are pushed inward by fingers at the outside of the sole 4 so that the downward wedges 12 of the inserts 10 are free from the upward wedges 22 of the snap units 16. The separation of the heel 6 from the shoe body 2 is finished by simply pulling the heel 6 backward with respect to the heel section of the shoe body 2.

As described above, the present invention provides sports shoes having exchangeable heels in which the eccentrically abraded heels can be separated from the soles and exchanged with each other so that the useful life of the sports shoes can be remarkably lengthened. The above exchange of the eccentrically abraded heels also compensates for the eccentric abrasion of the heels and overcomes the problems caused by the eccentric abrasion of the heels such as fracturing or twisting of in the wearer's ankle.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. Sports shoes each comprising:

an exchangeable heel detachably attached to a heel section of a sole such that it is exchangeable with another heel, said heel being axially recessed on its top center to have a trapezoidal recessed rail and having a pair of inserts, said inserts protruding forward from a front end of said heel and spaced apart from and parallel to each other and having downward wedges at their ends;

said sole recessed at its rear section to form said heel section, said heel section having a trapezoidal protruding rail on its outer bottom for substantially mating with said trapezoidal recessed rail of the heel; and a pair of snap units movably provided in said sole for snapping up said downward wedges of the inserts of the heel respectively, each snap unit comprising:

a movable snapping member partially having an upward wedge for engagement with the downward wedge of a corresponding insert of the heel; and an elastic member elastically movably mounting said snapping member in said sole such that when said snapping member is elastically inwardly pushed it allows said downward edge of the insert of the heel to be disengaged from aid upward wedge of the snapping member.

* * * * *